United States Patent [19]

Reitter

[11] 4,427,453

[45] Jan. 24, 1984

[54] TWO STAGE CONTINUOUS HYDROLYSIS OF PLANT BIOMASS TO SUGARS

[76] Inventor: Franz J. Reitter, Grovestrasse 13, München, Fed. Rep. of Germany, D-8000 50

[21] Appl. No.: 311,734

[22] PCT Filed: Feb. 21, 1981

[86] PCT No.: PCT/DE81/00036

§ 371 Date: Oct. 15, 1981

§ 102(e) Date: Oct. 15, 1981

[87] PCT Pub. No.: WO81/02428

PCT Pub. Date: Sep. 3, 1981

[30] Foreign Application Priority Data

Feb. 23, 1980 [DE] Fed. Rep. of Germany ..... 3006887

[51] Int. Cl.[3] ..... C13K 1/02

[52] U.S. Cl. ..... 127/1; 127/37

[58] Field of Search ..... 127/1, 37

[56] References Cited

U.S. PATENT DOCUMENTS

| | | | |
|---|---|---|---|
| 1,670,727 | 5/1928 | Kocher | 127/1 |
| 2,108,567 | 2/1938 | Schdler | 127/1 |
| 2,538,457 | 1/1951 | Hudson | 127/37 X |
| 2,681,871 | 6/1954 | Wallace | 127/1 |
| 2,739,086 | 3/1956 | Wallace | 127/1 |
| 2,801,939 | 8/1957 | Hignett | 127/37 |
| 3,212,932 | 10/1965 | Hess | 127/37 |
| 3,523,911 | 8/1970 | Funk | 127/37 X |
| 4,023,982 | 5/1977 | Knduth | 127/37 X |
| 4,072,538 | 2/1978 | Fahn | 127/1 X |
| 4,316,748 | 2/1982 | Rugg | 127/1 X |

FOREIGN PATENT DOCUMENTS 130582 4/1978 German Democratic Rep. .

*Primary Examiner*—Sidney Marantz

*Attorney, Agent, or Firm*—Beveridge, DeGrandi & Kline

[57] ABSTRACT

Process and apparatus for the continuous hydrolysis of plant biomass containing cellulose and hemicellulose. Chopped biomass is treated in a first stage in the presence of dilute acid, at temperatures and pressure conditions under which the hemicellulose and, partially, the cellulose are hydrolyzed during a first reaction to pentoses and partially, hexoses, whereupon the reaction mixture pressure is suddenly released and the hydrolysate is separated from the biomass, and in at least a further stage, cellulose in the biomass is hydrolyzed in the presence of dilute mineral acid and under more severe temperature and pressure conditions, to hexoses, whereupon again the reaction mixture pressure is suddenly released and the hydrolysate is separated from the remaining biomass, and in which the neutralized hydrolysate, is further processed for the production of sugars, wherein each hydrolysis stage comprises as reaction chamber, a continuously operating horizontal tube digester containing horizontal conveyor devices, the digester being connected on the entrance side with a conical worm filler with a perforated cone casing for the injection of the biomass and the outlet side is fitted with an outlet device which forms a pressure seal of the exit side of the reaction chamber, and which is connected via a blow pipe with a cyclone-shaped blow tank.

28 Claims, 4 Drawing Figures

TWO STAGE CONTINUOUS HYDROLYSIS OF PLANT BIOMASS TO SUGARS

The invention is concerned with a process for the continuous hydrolysis into sugars of pentosan-containing hemicelluloses, cellulose, and corresponding compounds of plant biomass. As a first step the appropriately pre-crushed biomass is treated in the presence of dilute acid at a specific temperature and pressure. Under these conditions mainly hemicellulose but partially cellulose, are hydrolyzed into pentoses and hexoses during the initial reaction. The reaction pressure is suddenly released and the hydrolysate is separated from the biomass.

In at least a further step, the cellulose in the biomass is hydrolyzed to hexoses in the presence of dilute mineral acid and under increased temperature and pressure. Again the pressure on the reaction mixture is suddenly released and the hydrolysate is separated from the biomass.

The neutralized hydrolysate is then appropriately processed for the production of sugars. The invention is further concerned with an apparatus for carrying out such a process.

The industrial production of sugar from cellulose-containing raw materials, especially from wood chips, was carried out for many years during the last war, until better economic conditions after the war made it unprofitable with conventional installations. The recent price increases of crude oil on the world market have led to the consideration of alternative raw materials for the production of fuels for combustion engines. In this connection sugar production from plant biomass, previously abandoned for economic reasons, now takes on new importance as the sugars may be fermented to ethyl alcohol, which can be used as fuel.

Sugar production from wood, as used during the war, was based on Scholler's percolator principle described in German Patent No. 640,775. In this discontinuous percolation process approximately 100 $m^3$ containers are used. The wood is boiled at 160° to 180° C. for several hours with dilute sulfuric acid and then the produced xyloses and glycoses are washed out. The rinsing is performed according to the principle known as percolation. This known process has the disadvantage that it requires long boiling times and does not permit the use of waste such as remnants of annual plants, old papers and other garbage because the strainers built into the boilers, which are needed for the recycling of the boiling acid, become plugged and the percolation stops. In addition the long boiling times require very large boiling volumes. For this reason, the installations previously used in West Germany contained approximately 30 to 40 percolators, each with 60 $m^3$ capacity. This lead to a substantial capital investment and to unjustifiably high energy consumption; for these reasons and others it became necessary to close installations.

A further process, based on the Scholler process, was developed by Eickemeyer and is described in German Patent No. 15 67 335. With the improved process, with discontinuously operating percolators, the initial impregnation of the biomass is said to be improved and steam use is reduced. This saves energy and gives a higher sugar concentration in the hydrolysate.

Because of the economic disadvantages of a discontinuous hydrolysis process one finds in the literature suggestions for continuous processes. However, so far it has not been possible to put these processes into practice. Currently there is no continuously operating sugar-producing process in operation.

Further improved hydrolysis processes are described in U.S. Pat. Nos. 2,801,939 and 3,212,932. The key point of these two patents concerns the conditions for the reactions. In both patents it is mentioned that the processes may be used continuously but the patents give no details of how this is to be achieved economically. U.S. Pat. No. 2,801,939 indicates that the biomass has to be sufficiently chopped up and mixed with a high excess of liquid so that it can be pumped. A high dilution however, leads to high energy costs and, more importantly, to lower concentrations of sugar in the hydrolysate which requires a high steam injection energy.

The present invention is a process of the general kind previously described and follows from the chemical-physical process conditions approximately described in U.S. Pat. No. 3,212,932. However, the invention permits economical production, by hydrolysis, of sugar from such common plant wastes, as, for example, sugar cane, trash, straw and old paper. The prime consideration is low investment cost, short reaction times and minimal excess of liquids compared to the raw material. This provides a high yield of cellulose and a hydrolysate with the highest possible concentration of sugar.

In the process of this invention the biomass is fed into the high pressure reaction vessel by means of a pressure seal-forming, continuously working, worm feeder, in which air and excess fluid, contained in the biomass, are largely removed. The hydrolysis takes place in the vapour phase in a continuous horizontal tube digester as the reaction vessel. The hydrolysate is separated from the reaction mixture in several steps.

The term "continuous horizontal tube digester" means boilers that are manufactured for example by American Defibrator Inc., New York, N.Y., U.S.A. and Black-Clawson Co., Pandia Division, Middletown, Ohio, U.S.A., for the production of cellulose. Such boilers are described by W. Herbert in TAPPI, Vol. 45 (1962) No. 7 S 207A–210A and by U. Lowgren in TAPPI Vol. 45 (1962), No. 7, S. 210A–215A. Such boilers are well known to the skilled man.

The term "worm feeder" includes devices known commonly as worm pressers. This device consists of a conical, pressure resistant housing, in which a conical worm with a rotation drive is installed. The housing has at the end of its larger diameter, a generally radial charging opening and ends at its smaller diameter with a generally cylindrically shaped, axial, exit sleeve.

The material is injected into the charging opening and is moved by the worm under strong compression, and thus high pressure, to the smaller end where it is forced through the exit sleeve as a compressed plug. The plug tube or exit sleeve can be chosen in such a way that the plug forms a sufficient pressure seal under continuous feeding of the material into the pressure vessel. The conical housing is provided with perforations so liquid is squeezed out from the material during the compression.

Worm presses of this type are also described in the literature mentioned in connection with the horizontal tube digester.

In the following the word "continuous" as applied to a continuous process refers primarily to the procedure within a hydrolysis stage. According to the invention the at least two stage hydrolysis process may therefore, if necessary, also be executed with a one stage installation, by operating this alternatively as first stage and following stage. In larger installations, one should however, operate the installation multi-stage, since certain technical flow circuitry advantages of the invention can only be achieved with a multi-stage installation.

The application of a continuous tube digester with a worm feeder offers considerable advantages for the technical execution of a continuous saccharification of biomass. By using the worm feeder it is possible to inject into the high pressure reaction space in the digester, the shredded material, essentially free of excess liquid, and more importantly, essentially free from air inclusions, which are disadvantageous to the hydrolysis. In almost all practical process embodiments, the biomass comes in contact with liquid before entry into the reaction chamber. In process embodiments with reaction times that are not too short, it is useful to pre-impregnate the biomass, with mineral acid-containing pre-treatment fluid under intensive mixing before injection into the first hydrolysis stage. For a perfect impregnation one has to work with a certain excess of fluid which can be reduced again to the level desired for hydrolysis without a further process step, by means of the worm feeder before the digester. With extremely short hydrolysis times, when it is appropriate to inject the mineral acid catalyst solution directly into the boiler, the biomass, should first be washed and preheated. It then comes into contact with liquid and the excess may be removed most simply in the worm gear extruder of the digester.

The tube digester itself permits hydrolysis with the shortest reaction times and with the smallest possible excess of liquids, in the vapour phase, which leads to considerable direct energy saving. Secondary energy saving is achieved by the fact that the hydrolysis mixture is present in relatively high concentrations.

The delivery of the reaction mixture from the digester can occur by means of a known blow valve via a blow pipe into a cyclonic blow tank. In this embodiment the separation of the hydrolysate from the reaction mixture follows the sudden pressure release, namely the blow-off of the reaction mixture from the boiler. The multi-stage separation of the hydrolysate from the reaction mixture occurs appropriately in a counter current of the hydrolysate, that is a countercurrent washing with a possible small dilution of the hydrolysate. During the last separation stage fresh water is used for the washing of the biomass. Concentrated hydrolysate from the first separation stage, following the digester is used in further processing. The separation device is preferably a separation worm and/or double wire press. Generally a three-step hydrolysis separation for this process is sufficient.

The term "worm separators" in this specification includes worm extruders that are similar in principle to the filler worms. They have a perforated casing for the separation of liquid. However, if they are not to be used for working against a container pressure they need not form a pressure sealing plug and can, if necessary, be used with less sealing.

The term "double wire press" includes a device which is manufactured and distributed under this name by Maschinenfabrik Andritz Actiengesellschaft in Graz, Austria. Instructions on how to work these double wire presses are written up in "Das Papier" (1968) No. 12, P. 908–914 by F. Wultsch.

The double wire press consists, in principle, of two wedge-shaped, converging endless wire screens and draining is accomplished by purely mechanical means without a vacuum. The suspension which is conveyed by a pump to the machine head box, is pre-drained in an essentially horizontal wedge zone. In the following slanted, rising pre-press part, the drainage process is continued with mechanical pressing. As a result of the rising sieve it is possible to install water take-up flumes within the upper wire loop at the rear or upstream end of the press unit for draining water extracted by the upper wire before it is reabsorbed by the biomass.

In this way a re-moistening can be substantially prevented.

In a preferred embodiment the hydrolysate separation takes place at least in the first separation step under the pressure seal of the reaction chamber, whereby the sudden pressure release as the reaction mixture passes into the blow tank takes place only after this first separation step. In this case the first separation device consists of a worm separator, which is directly attached to the outlet end of the tube digester and which forms a unit with the digester under the pressure seal. For this purpose the worm separator has on the outside of its conical perforated casing a shell surrounded by a pressure-tight housing spaced from the casing. Only the plug tube at the end of the worm casing extends through the housing. In the pressure-tight housing the separated liquid gathers, and can be drained off via a drain line under pressure or by a decompression valve. From the plug tube of the worm separator the reaction mixture, i.e. the remaining mass after the first hydrolysate separation, is blown off into a blow tank over a blow line. One can then add further separation steps, downstream of the blow tank, for the hydrolysate separation. In a special embodiment that can be useful, the hydrolysate separated in the worm separator is blown off via a blow valve into a separate blow tank. Should the hydrolysate separation have to take place in a total counter current of the hydrolysate one must raise it, in the first separation step, by means of a pump, to the pressure of the digester exit.

The carrying out of the process with the above installation has the advantage that one can do without a separate blow valve for the compact mass in the digester. This valve can give trouble. The exit pressure plug of the digester is formed safely by the separation worm and its conical casing. The controlled discharge of the reaction mixture from the digester takes place through a corresponding rotation movement of the worm. A pressing of the hydrolysate in the worm separator is not absolutely necessary since a hydrolysate separation can be accomplished by a difference in pressure between the digester inner chamber and the worm casing surrounding the housing. A further advantage of this process is that, for example, in a two step process, the second-step separated hydrolysate can be kept under such a pressure that steam escaping from the hydrolysate due to pressure relief can be used for heating in the first step. Further the hydrolysate can be used as an acid solvent and heat source in the first hydrolysis stage. The latter possibility is only available if the hydrolysate of the separate hydrolysis stages is not to be used at any time directly for further processing. To achieve minimal addition of mineral acid catalyst it is useful to proceed as described above. And, at least in a two stage hydrolysis the hydrolysate of the second stage, which still contains generally enough mineral acids, should be used directly as a solvent for the first hydrolysis stage. In this case the hydrolysate would not only be carried counter current in each separation step, following each hydrolysis stage, but through the whole installation, so that only the hydrolysate of the first separation step at the first hydrolysis stage is passed for further processing. Despite the above advantages of operating the process with countercurrent flow, one can dispense with the hydrolysate passage and reduce the hydrolysate from each hydrolysis stage for further processing.

This is especially the case in a further preferred embodiment of the invention, in which the hydrolysate after each single hydrolysis stage, that is at the exit end of the digester or in the blow line, is neutralized. The advantage of this embodiment is the removal from the reaction mixture of its strongly corroding characteristics. Thus the installation following the blow line, including the blow tank and, especially, the further separation devices such as counter current washing devices for the hydrolysate, need not be constructed of acid resistant materials. This feature is of importance for the practical operation of this installation and for economy.

When the hydrolysate separation after a hydrolysis stage is followed by a further hydrolysis stage, the worm filler for the digester of the next stage, may be a last separation step for the hydrolysate separation in the preceding stage. This is possible when worm separators are used for the hydrolysate separation and when these worm separators work essentially in the same way as the worm fillers of the digesters. This leads to considerable simplification for the installation.

In horizontal tube digesters, as used in cellulose production, there is usually a vertical fall tube between the worm filler and the proper digester tube. The plug tube of the worm filler ends horizontally in the upper end of the fal tube. This arrangement is chosen to install across the outlet of the worm filler a closure device for the outlet, a so-called "blow back damper". This damper prevents a failing pressure seal of the material plug and blow-back of the boiler.

In contrast to the production of cellulose, in which the end product is the solid fiber material which should not be damaged in its fiber structure, in hydrolysis the hydrolysate as a product is important and not the solid material. Thus it is useful to have the initial biomass largely shredded or comminuted. It has been shown, that under such conditions a safe pressure seal by the plug in the worm filler is attainable, so that the worm filler can lead directly into the digester tube. This can be important in hydrolysis with very short reaction times. In order to dismantle the strongly sealed plug after its direct entry into the digester tube for the reaction it is useful to install behind the outlet of the worm filler steam inlets on the inside of the digester.

For not too short reaction times, in the neighborhood at 1 to 6 minutes, it is generally useful to pre-impregnate the biomass before the first hydrolysis stage with the acidic reaction liquid. This can, for example, be accomplished by intensive mixing of the material with reaction liquid in excess, in a known so-called two shaft mixer. The excess reaction liquid is then removed in the worm filler of the digester. For very short reaction times it may be necessary to avoid the pre-impregnation. In this case the reaction liquid is directly injected into the digester. In this procedure a two shaft mixer used before the first hydrolysis step can be an advantage. This impregnates the biomass alone with liquid, thus reducing air inclusions, and preheats for the boiling process.

For ideal performance the condition of the biomass fed into the first stage is of concern. It may be necessary to clean the biomass before the impregnation with the dissolution liquid or before the pre-heating. Dust is preferably removed with a wet cyclone. Wet cleaning may be carried out for example, with a device according to the published German Patent applications Nos. 26 13 510 and 26 20 920. In wet cleaning an aqueous suspension of the biomass of 3 to 5% solids may be used. The chopping of the biomass, generally done before cleaning, is usually accomplished with a shredder. Preferably grain sizes of 0.1 to 3 mm, more preferably from 1 to 2 mm are used. The above statements about the cleaning and chopping refer essentially to plant residues from annual plants, waste paper and similar materials. Varying conditions are necessary for wood digestion. The wood must not be in the form of large chips as they are used in the conventional, discontinuous percolation, but must be in the form of fine shavings, sawdust or similar materials. Especially in the digestion of wood several shredding steps may be necessary.

The hydrolysis of hemicellulose in the first hydrolysis stage takes place most conveniently at temperatures of approximately 135° to 190° C. and at corresponding pressure. The reaction time is preferably about 0.05 to 5 minutes but if desired, the reaction times can be extended to 20 minutes. For hydrolysis of the cellulose in a second or further stage it is preferable to work at temperatures in the region of 210° C. to 250° C. and corresponding pressures. The reaction time can be of the same order of magnitude as for the first stage. It is desirable to have the smallest possible ratio of liquid to solids, for example in the range of 3:1 to 1.5:1, preferably, in the region of 2:1. The application of a worm press with perforated worm housing has the special advantage that the excess liquid may be squeezed out again immediately before the mass enters the digester, even after impregnation of the biomass in the two shaft mixer, without a further process step being required. It should be emphasized that an essential point of the process is that with use of a worm press it is possible to remove almost 100% of the air, which is extremely harmful to the hydrolysis, from the chopped biomass, before entry into the digester.

The acids used in the hydrolysis in accordance with the claimed process are mineral acids, preferably sulphuric or hydrochloric acid in diluted form. As the acid merely serves as a catalyst and has to be removed from the hydrolysate, it is desirable to use as little as possible. This is helped by the relatively high hydrolysis temperatures required, as under these conditions the organic acids present in the biomass begin to act hydrolytically. In the complete counter current passage of the hydrolysates through all stages without any intermediate neutralization, in general mineral acid need only by added in the last stage.

Even if the addition of added chemicals is kept as small as possible, it is still of importance for economic reasons to recover the added auxiliary materials especially when intermediate neutralization is used. The removal of the acids from the hydrolysate occurs usually at neutralization by precipitation of salts of the acids. In a preferred embodiment of the process, the precipitated salts from the hydrolysate and the remaining biomass leaving the hydrolysis process, are subjected to a two stage burning. The remaining biomass essentially consists of lignin. In the first burning stage reducing conditions are used, i.e. with excess CO. In the second burning stage oxidizing conditions are used to recover the mineral acid and the neutralizer. With dilute sulfuric acid as mineral acid, the acid is usually precipitated from the hydrolysate with lime with the formation of calcium sulfate. During the simultaneous burning of the lime together with the biomass in the reducing burning stage, in which the biomass serves as fuel, calcium sulfide may be formed. In the second oxidizing burning stage this is transformed to calcium oxide. From the flue gas sulfur dioxide is recovered and converted to sulfuric acid.

To simplify recovery of chemicals it may be an advantage to work directly with sulfur dioxide as catalyst in the hydrolysis.

The invention also provides an installation for the execution of the process. The above description of the characteristics inherent in the invention of the process is largely also applicable to the corresponding installation.

The horizontal tube digesters may comprise one or more tubes, depending on the required transmission quantity and reaction time. In the case of several horizontal tubes, these are usually arranged below one another and in each case the exit of one tube is connected with the entrance of the next following tube by means of a short drop tube. Each tube usually contains a means of conveying the reaction mixture, for example a worm conveyor.

In the following, the invented process and the corresponding installations, are further explained in detail, with reference to the enclosed process scheme.

BRIEF DESCRIPTION OF THE DRAWINGS

As shown in FIG. 1 the chopped and pre-cleaned biomass arrives at a conveyor belt 2, preferably fitted with an automatic measuring scale (not shown), into a double shaft mixer 3, of known construction. The biomass is pre-impregnated with acidic liquid, which is added through an automatic control valve 4 contained in pipe 5. The dissolution liquid is added in direct proportion to the weighed biomass on the conveyor belt. Through a pipe 6 additional blow steam from the process, is added for heating the biomass in the double-shaft mixer.

Figure 1:
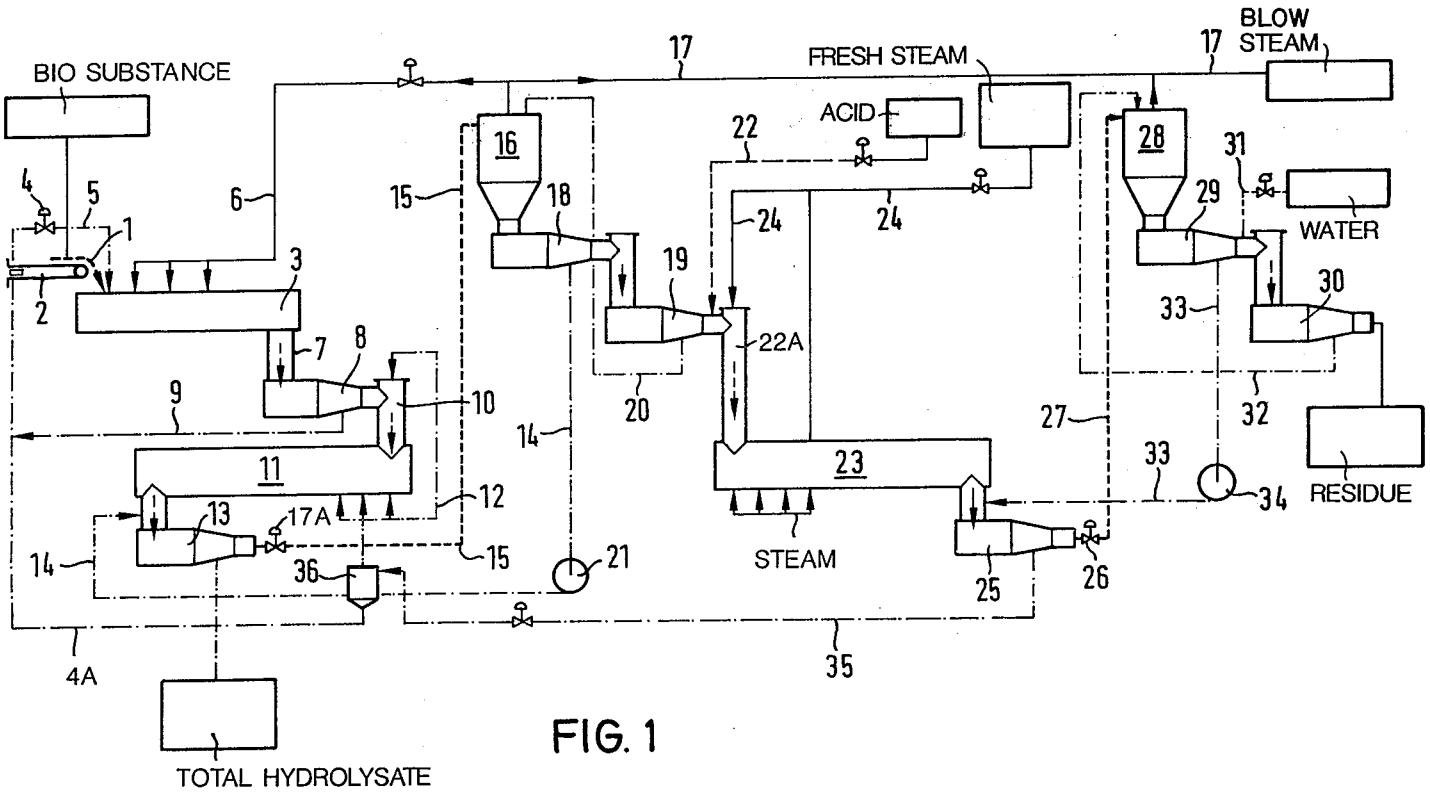
FIG. 1 is a flow diagram of a first embodiment of the process according to the invention.

In the double-shaft mixer 3, which is preferably also used for impregnation, the liquid is intensively mixed with biomass, by the two rotating worm gears of the mixer. The liquid penetrates the damp raw material and prepares it for the fast vapour phase disintegration. From the outlet of the double shaft mixer, the impregnated biomass falls by gravity through a drop chute F, into the feeder opening of the worm filler 8, which is part of the digester. In the worm filler 8, the biomass is compressed by a rotatable filler worm into the conical casing around the worm. A dense plug is thus formed which forms the pressure seal on the entrance side of the digester inner chamber. Excess liquid in the biomass is pressed out through the perforated worm housing and then returned through a pipe 9 into the impregnation circuit. In the worm filler 8 the majority of the air contained in the biomass is further removed and the filler worm transports the material with minimum moisture contact into the boiler. By this means steam is saved and the hydrolysis is improved during the vapour phase.

After the outlet of the worm filler 8 the biomass falls through a chamber in the form of a drop chute 10 which ends in the horizontal digester tube of the digester 11. The horizontal digester 11 is fitted inside with a conveyor worm (not shown) the speed of which may be varied to influence the time of contact of the biomass in the digester 11. Digester 11 only has one tube but depending on transmission capacity and time of contact it can also be built to contain two or more pipes.

The digester 11 is heated with steam from pipe 12 which branches to several boiler connections. In the present embodiment the steam is obtained through release of the hydrolysates held under pressure in the second hydrolysis stage, as further explained below.

After the digester the reaction mixture falls into a discharge device, which in the embodiment shown consists of a worm separator 13, similar in construction to the worm filler 8. At the entrance to the worm separator 13, hydrolysate from the counter current operated second hydrolysis stage is added to the reaction mixture through pipe 14. The hydrolysate is separated through the conical casing of the worm separator 13 in this embodiment, the total hydrolysate from both shown hydrolysis stages. This hydrolysate leaves the hydrolysis plant at this point and is removed for further processing. The constricted orifice of the worm separator 13 is connected through blow line 15 with a cyclone-like shaped blow tank 16, into which the blow line 5 enters at the upper end tangentially. Immediately downstream of the orifice of the worm separator 13 an emergency valve 17A is positioned in the blow line 15. The output from the digester is thus determined by the rotation speed of the worm: The hydrolysate separation occurs through the pressure difference between the inner chamber of the digester 11, the worm separator 13, and the outer chamber surrounding the conical casing. Additional pressure from the worm can be advantageous, but is not necessary. The remaining residual biomass, after separation of the hydrolysate in the worm separator 13, is blown out via blow pipe 15 into blow tank 16. A pressure release occurs in tank 16 and steam is thus released from the remaining reaction mixture.

The blow tank 16 is closed and is kept under small over pressure, in order to capture the released steam. A part of this blow steam, as already mentioned, is directed via the pipe 6 to the double shaft mixer 3. The remaining blow steam reaches, via a pipe 17, other places of application in the process. At the lower exit of the blow tank 16, two further worm separators 18 and 19 are arranged in series. Rinsing of the hydrolysate from the biomass is carried out at the lowest possible dilution in separator 18 and 19. Rinsing is carried out by counter current liquid flow. The worm separator 19 also serves as the worm filler for the digester of the following stage and thus represents the joint between the first and second hydrolysis stages. The squeezed out liquid from each worm separator is returned, in accordance with the counter current wash principle, from time to time to the preceding hydrolysate separation stage. Thus the squeezed out liquid from the worm separator 19 returns via a pipe 20 to the blow tank 16 before the worm separator 18. Its separated liquid is returned via pipe 14 into the outlet of digester 11 and to the directly connected worm separator 13. Since this requires feeding of liquid into the pressure chamber of the digester, a pump 21 for raising pressure is provided in pipe 14. This raises the wash hydrolysate to the corresponding pressure. After the remaining hydrolysate of the first hydrolysis stage has been largerly removed from the remaining biomass in the worm separator 19, working as third hydrolysate separation step, mineral acid is added to the biomass, after it has passed the orifice of the worm separator 19 for the second hydrolysis stage forming the worm filler through pipe 22. Dilute sulfuric acid is preferred. The acid acts as catalyst for the hydrolysis and is added in proportional amounts. Because the reduced pressure behind the orifice piece, the acid is readily accepted. From the worm filler 19, the remaining impregnated biomass goes by a drop chute 22A into the tube digester 23 of the second hydrolysis stage, which is of the same type as digester 11 of the first hydrolysis stage, but can be adapted to the requirements of the second stage, and thus does not need to agree exactly with the digester of the first stage. In the illustrated embodiment the digester 23 of the second hydrolysis stage, which operates generally under a higher pressure than the first stage is heated by fresh steam via a pipe 24.

The apparatus following the digester 23 of the second hydrolysis stage correspond essentially with those of the first hydrolysis stage. The digester 23 is joined at its exit with a worm separator 25, which is connected to blow tank 28 via a blow pipe 27, which has an additional blow valve 26. Two more worm separators 29 and 30 are joined to this.

The remaining biomass, mostly lignin, leaves the process after the orifice of the last worm separator 20 and may be burned as fuel. Between the worm separators 29 and 20 wash water is added to the remaining biomass via a pipe 31. This water is preferably heated and can be recovered water from the installation. Separated wash hydrolysate is returned from the worm gear generator 30 via a pipe 32 to the blow tank 28, and thus to the second hydrolysate separation step formed by gear separator 29. This separated liquid passes to worm gear separator 30 through pipe 33, which is under digester pressure. For this reason there is also a pressure raising pump 34 in pipe 33.

The pressurized hydrolysate of the second hydrolysis stage separated in the worm separator 25 with its connecting digester 23 is returned by pipe 35 to the first hydrolysis stage but passes first to a release vessel 36 where steam is released by pressure release. The released steam is led via pipe 12 to the digester 11 of the first stage as a heat source. The hydrolysate of the second stage then passes through pipe 4A for pre-impregnation of the fresh biomass in the double shaft mixer 3 of the first hydrolysis stage.

As is demonstrated FIG. 1, fresh steam is only used for heating the digester of the second stage. The digester of the first stage is heated with steam released from the second stage hydrolysis. The hydrolysate is led through the installation counter current while being enriched. Only before the last separation step after the second hydrolysis stage, is wash water added. The three step hydrolysate separation after the second digester is carried on counter current. The hydrolysate separated in the worm separator 25 in the first separation stage behind the second digester is all added to the biomass after the first hydrolysis stage and is enriched during the first hydrolysis stage with the hydrolysate of this stage. After the digester of the first stage a counter current rinsing takes place so that the more concentrated total hydrolysate of both hydrolysis stages from the first hydrolysate separation step after the first digester can be led off. Since the mineral acid hydrolysate of the second hydrolysis stage is used as dissolution liquid in the first hydrolysis stage, one need not add fresh mineral acid. The addition of fresh mineral acid occurs only before the digester of the second hydrolysis stage. Known devices for directing and controlling the process have been purposely left out in the process scheme of FIG. 1 for clarity.

Figure 2:
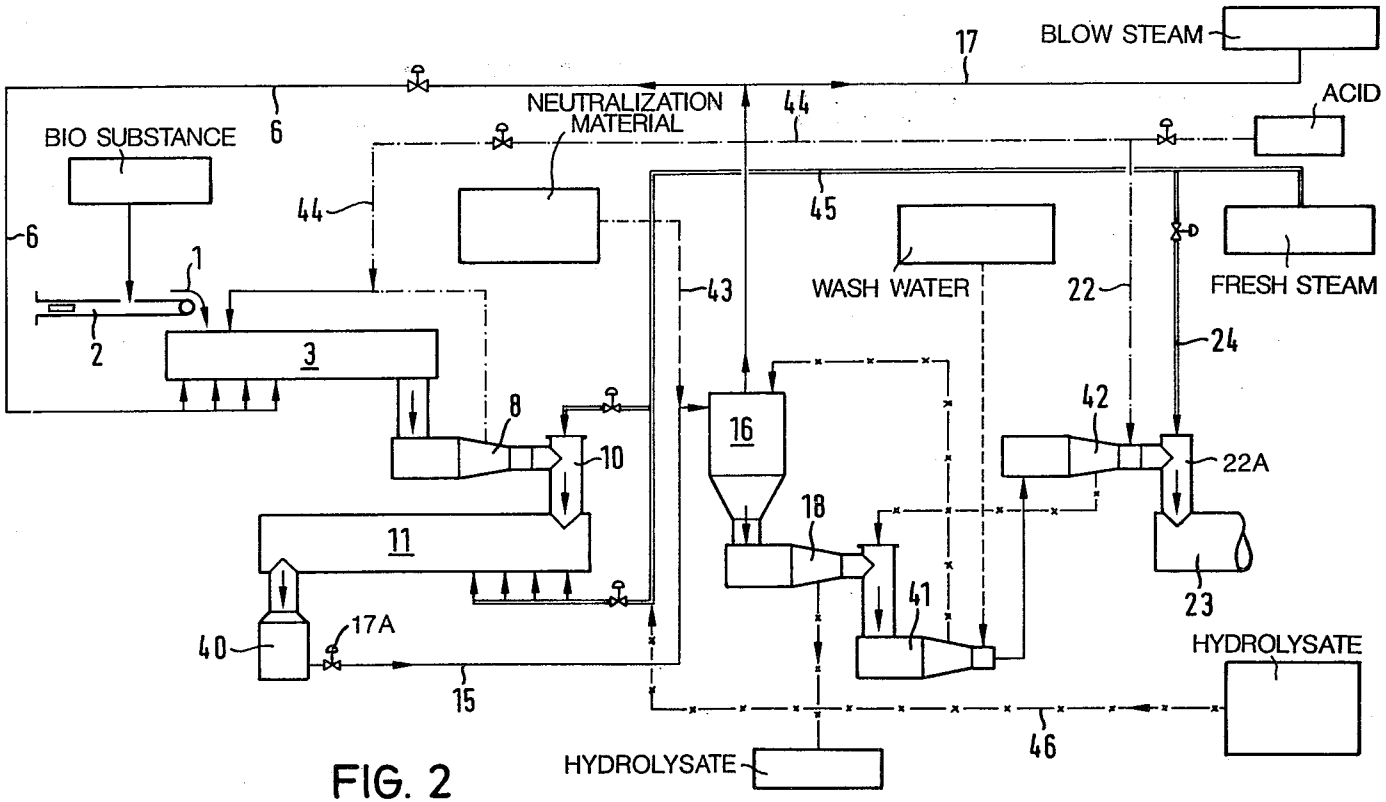
FIG. 2 is a flow diagram of the first hydrolysis stage of a process embodiment.

In FIG. 2 a variation of the process is presented in the form of a simplified flow diagram. Only the first hydrolysis stage is shown, and one or two further similar hydrolysis stages can be added.

The process of FIG. 2 differs from that of FIG. 1, in that at the exit end of digester 11 no pressurized worm separator is present. There is merely a vessel 40 which is joined by pipe 15 to blow tank 16. The output from digester 11, is solely regulated by the blow valve 17.

To compensate for the missing worm separator at the digester exit in FIG. 2 a three step hydrolysate separation by means of worm separators 18, 41, and 42, after the blow tank 16, is provided. None of these separation steps is under a pressure seal.

An intrinsic characteristic of the process scheme in FIG. 2, is that a pipe 43 is led into the blow line 15. A neutralizing material, preferably milk of lime, can be injected directly into the blow line through pipe 43. The entry of pipe 43 into the blow line 15, which consists of appropriate injection devices, is preferably close after the blow valve. This turbulence in the blow line which helps mixing between reaction mixture and neutralization material. This facilitates complete neutralization of the reaction mixture. The advantage of this process is that the blow tank 16 and all the following apparatus of this stage, especially the worm separators 18, 41 and 42, need not be constructed from acid resistant material. For the same reason the otherwise favourable construction of a worm separator directly at the exit of digester 11, is not present in FIG. 2.

If one wishes to work in the second (not shown) hydrolysis stage in the same manner it is not possible to return the neutralized hydrolysate of the second stage as dissolution liquid into the first stage because the acid, necessary as a catalyst, has been removed through neutralization. Accordingly, fresh acid is led through pipe 44 to the first hydrolysis stage.

The addition is made in the double shaft mixer 3 and into the worm filler 8.

Without a first hydrolysate separation stage under pressure, directly after the digester (not shown) of the second hydrolysis stage, there is not enough pressurized hydrolysate present to provide all the steam for heating the digester of the first stage. Therefore the digester 11 of the first stage is at least partially heated with fresh steam from pipe 45. It is possible, however, to remove part of the hydrolysate under pressure from the second digester without a real separation device, by means of a vessel after the first digester corresponding to vessel 40. By release of the pressure of this hydrolysate an amount of steam is provided that can be led via pipe 46, to the digester 11 of the first stage, which is working under lower pressure. This measure makes it, at least in part, possible to transfer certain advantages of the embodiment according to FIG. 1 into the process according to FIG. 2.

According to the process of FIG. 1, the hydrolysate is carried through the whole installation counter current. It is thus only between neutralizations that it is possible to bring together the neutralized hydrolysates of the single stages, to have them undergo further joint processing.

Apart from the total counter current flow of the hydrolysate, the process characteristics of both the above embodiments can however also be combined. It is possible in the process of FIG. 2, to place a separation device which works under digester pressure at the outlet of each digester. Such a measure can also be used only in the second hydrolysis stage as it is then possible to make the total hydrolysate from the second stage, which was under pressure, useful for the production of heating steam for the first stage. The disadvantage of the process of FIG. 2 is that the pressurized separation device, positioned before the blow tank, has to be constructed of acid resistant material, since the neutralization takes place only in the blow pipe after this separation stage. Otherwise it is also possible, as with FIG. 1, to neutralize the reaction mixture in the blow pipe 15 of the first hydrolysis stage, but to delete an appropriate measure in the second hydrolysis stage. Therefore, the worm separators 18 and 19 can at least be constructed from cheaper material. With a hydrolysis installation according to FIG. 2, in a two stage execution, one can produce from 1 ton of mixed biomass, calculated as dry solids and consisting of $\frac{1}{3}$ each of wood, waste material, grain straw, waste papers and garbage, about 500 kg of sugar as a mixture of pentoses and hexoses. The required quantity of the catalyst is about 0.3% based on the initial raw material used. With this the reaction time in the first hydrolysis stage takes about $2\frac{1}{2}$ minutes at 180° C. and the reaction time in the second hydrolysis stage about $4\frac{1}{2}$ minutes at approximately 235° C. The remaining cellulignin after the second stage consists of 25 to 28% of the starting substance and is sufficient to generate through burning the required process heat as steam with a pressure of about 28 to 30 bar.

Figures 3, 4:
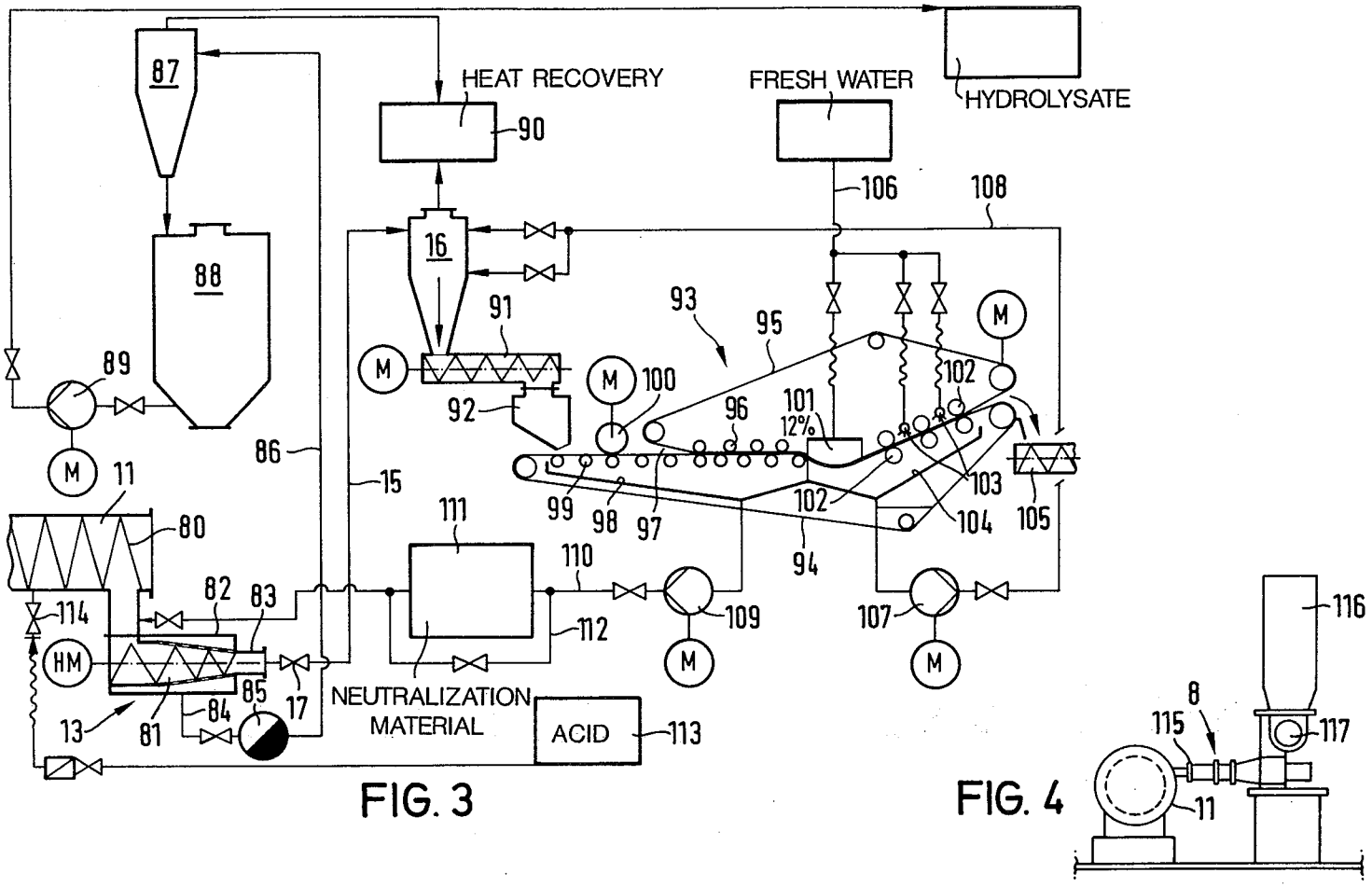
FIG. 3 is a flow diagram of a further embodiment.
FIG. 4 is a special arrangement of the worm filler in relation to the horizontal tube digester.

In FIG. 3 the essential parts of a further embodiment of a hydrolysis stage are presented schematically. The stage may serve, for example, as a first hydrolysis stage. For reasons of clarity auxiliary devices generally known to the skilled man are omitted.

FIG. 3 shows on the left merely the outlet of the horizontal tube digester 11. On the inside of digester 11 the worm conveyor 80 is indicated, which is responsible for the material transport in the reaction chamber. The reaction mixture arrives at the end of the digester through free fall, as in FIG. 1, in a worm separator which, together with the digester, works under pressure seal of the digester inner chamber. For this purpose, the perforated worm casing 81 is surrounded by a pressure-tight housing 82 through which only the plug pipe 83 of the worm separator extends. From the plug pipe 82, as shown in FIG. 1, a blow pipe 15, secured by a safety valve 17 leads into the blow tank 16 for the biomass. The housing 82 of the worm separator 13 is fitted with an outlet branch for discharge of the hydrolysate between the cone casing 81 and the housing 82. Since this hydrolysate chamber is also under pressure a blow valve 85 is connected to connection 84, after which the hydrolysate pressure is released and is blown through a second blow pipe 86 in a hydrolysate blow tank 87. The hydrolysate runs from here by gravity into a hydrolysate collecting container 88, from where by means of a pump 89 it is passed to further processing. As will be seen, from the following description, the hydrolysate separated by the worm separator 13 is the concentrated and neutralized hydrolysate of the last separation stage.

The vapour accumulated in the blow tanks 16 and 87 is led to a heat recovery installation 90 in which, for example, the fresh water for the last rinsing of the biomass in the last hydrolysate separation step may be preheated, for example up to 60°.

The biomass, is drawn off at the lower end of the blow tank 116, by means of a conveyor worm 91. It is led via a material feeder installation 92 to a double wire press 92 for further hydrolysate separation. The double wire press 93 has an endlessly rotating lower wire 94 and an endlessly rotating upper wire 95, which form an increasingly narrowing crevice between a row of horizontal pairs of rollers 96. The biomass is led into the crevice between the wires. Under the pressure of the roller pairs 96 liquid is separated and collected in a first collection tank 98. The lower wire defines a path carried by rollers 99 for feeding the biomass. Over wire 94 a driven equalizer roller 100 is arranged to compact the biomass and make it uniform. Roller 100 is on the lower wire 94, before the crevice area 97. At the end of the first liquid separation stretch adjacent the roller pairs 96, are wires 94 and 95 which hold the biomass between them. The wires pass around a wash device 101 where pre-warmed fresh water or other wash water rinses the last hydrolysate out of the biomass. After the wash device 101 the two wires pass through a rising section defined by three press roller pairs 102. Before the second and third press roller pair 102 once again wash water is added from above onto the wires by pipes 103. The liquid separated from the biomass by the press roller pairs 102 is collected in the second collecting pan 104. The water squeezed-out from the press roller pairs 102 through the upper wire 95, can be caught by collecting grooves (not shown) placed in front of each upper press roller as seen in the conveyor direction, because of the rising wire path, and may be led into the collection pan 104, without danger of re-moistening the biomass before each press entry. The biomass leaving the press stretch arrives by gravity in a conveyor worm 105 which passes it for disposal. The installation consists of three sequential counter current hydrolysate-washing steps. Of these, as seen in the conveyor direction of the biomass, the first consists of the worm separator 13 and the other two are located in the double wire press 93. The specific hydrolysate wash circuits are as follows:

Before and between the roller pair presses 102, from a fresh water pipe 106, preferably prewarmed freshwater is added to the biomass from a supply pipe 106 to the last hydrolysate washing. The washwater collected is this last hydrolysate-separation step in the collection pan 104 is added by a pump 107 via a pipe 108 into a blow tank 16 in front of the second hydrolysate separation step, formed by the horizontal draining section of the sieves 94 and 95, flaned by the roller pairs 96. The weak hydrolysate collected in this stage by the collection pan 98 is introduced by means of a compression pump 109 via a pipe 110 into the exit end of the digester 11 in front of the worm separator 13. In the worm separator 13 the final hydrolysate at the highest concentration is withdrawn and delivered via the blow tank 87 to the storage container 88 for further processing.

A special characteristic of the example of FIG. 3 is that a means of adding neutralizer 111 is provided. With this the neutralizing agent may be added directly into the weak hydrolysate moving through pipe 110. Thus enters the outlet of the digester 11 and neutralizes the reaction mixture before entry into the worm separator 13. This removes the strongly corrosive properties of the hydrolysate. Because of this measure it is possible to neutralize without use of further dilution water before the first hydrolysate separation step in the digester. Through this the advantages of the FIGS. 1 and 2 scheme are combined. The device for addition of neutralizer 111 is fitted with a bypass-pipe 112. Indicated in FIG. 3 is also a catalyst- or acid-preparation installation 113, from which catalyst under pressure may be injected by means of one or more injection pipes 114 at an appropriate place in the boiler 11.

The circles M in FIG. 3 symbolize the driving motors for the various components.

As already mentioned above, the method of injection of the biomass into the horizontal tube digester 11 may be of importance. FIG. 4 shows an arrangement of the worm filler 8 in relation to the horizontal tube digester 11, as planned for the installation plan according to FIG. 3, but not shown in the process scheme. With known digesters as used for the preparation of cellulose for reasons described above one allows the plug tube of the worm filler to end in a vertical drop tube 10, as shown in FIGS. 1 and 2. It was found that under the conditions for the hydrolysis of chopped biomass, it is also possible for the worm filler 8 with its plug tube 115 (FIG. 4) to end immediately in the digester tube of the digester 11. In this case an arrangement is especially useful in which the axis of the worm filler 8 is horizontal and at right angles to the horizontal axis of the digester 11. The plug tube enters approximately tangentially in the upper region of the digester tube, as may be seen from FIG. 4. In FIG. 4, also shows an intermediate silo 116 above the conveyor end of the worm filler 8. The biomass may be fed from silo 16 by means of a worm conveyor 117 or directly, by means of a mixer mounted in front, into the worm filler 8. For the direct connection of the worm filler 8, to the digester 11, illustrated in FIG. 4, special conditions are required for the dimension of the worm and the formation of the plug tube. To avoid backblow of the boiler through the worm filler 8. It is desirable to have within the worm filler, between its entry and the plug tube a volume compression ratio of at least 1:4. Further the ratio of length of diameter of the plug tube is at least 2:1. However, the worm should have such dimensions that with appropriate input a density of the biomass in the plug tube of at least 350 kg/m$^3$ may be obtained. In these circumstances, with a direct connection between worm filler and digester, one can work safely. This direct connection is preferably chosen for short reaction times in a fast reaction.

To disintegrate the produced high density plug which entered the digester for the reaction process, it is desirable to arrange the steam supply for the boiling process in such a way that the steam injection occurs directly behind the place of entry of the compressed biomass, and is directed into the plug in such a way, that the plug breaks down.

I claim:

1. Process for the continuous hydrolysis of pentosan-containing hemicelluloses, cellulose and corresponding compounds in plant biomass to sugar, in which chopped biomass is subjected in a first stage, in the presence of dilute acid, to temperature and pressure conditions under which the hemicellulose and only partially the cellulose are hydrolyzed during a first reaction time to pentoses and, partially, hexoses, whereupon the pressure of reaction mixture is released and the hydrolysate is separated from the biomass and in which, in at least one further stage, cellulose in the biomass is hydrolyzed during a further reaction time to hexoses in the presence of dilute mineral acid and under more stringent temperature and pressure conditions, whereupon the reaction pressure is released and, the hydrolysate is separated from the remaining biomass, and in which the hydrolysate is further processed, for the production of sugar, wherein the biomass under mechanical pressure is fed into the pressurized reaction chamber while simultaneously substantially removing the air and excess moisture contained in the biomass, the hydrolysis being carried out in a steam vapour phase in the reaction chamber, and in which hydrolysate is separated in several separation steps from the reaction mixture.

2. Process according to claim 1 in which the biomass for feeding to the reaction chamber is compressed at least in the volume ratio 1:4 to provide a density of at least 350 kg/m$^3$ and thereafter is disintegrated by steam used for the reaction.

3. Process according to claim 1, in which the multistage hydrolysate separation takes place exclusively after the sudden pressure release of the reaction mixture.

4. Process according to claim 1, in which a hydrolysate separation takes place in at least a first separation stage under the pressure seal of the reaction chamber and the pressure release takes only place after this separation.

5. Process according to claim 4, in which the hydrolysate separated under pressure seal, separate from solids, is suddenly subjected to pressure release.

6. Process according to claim 4, in which as separation device for the first separation stage a pressurized separation worm is used, which is connected directly to the exit end of the digester, and that the pressure release of the remaining reaction mixture occurs through the plug tube of the separation worm.

7. Process according to claim 4, in which a pressure release is followed by further separation stages, in which, as separating device separation worms and/or double wire presses are used.

8. Process according to claim 7, in which two or more separation stages are carried out by means of a double wire press.

9. Process according to claim 1, in which the hydrolysate separation after each hydrolysis stage occurs counter current of the hydrolysate, by adding generally fresh water before the last separation stage and by adding in each case the liquid separated in one separation stage before the preceding separation stage whereby the hydrolysate, in case of pressure release between the separation stages, is raised to the higher pressure level for the separation stages before the release.

10. Process according to claim 1, in which, with the exception of the last hydrolysis stage, in each hydrolysis stage hydrolysate from the next following hydrolysis stage is used as acid-containing dissolution liquid and only the hydrolysate separated in the first separation stage after the first hydrolysis stage is used for further processing.

11. Process, according to claim 1, in which the hydrolysate of each hydrolysis stage is removed directly for further processing.

12. Process, according to claim 11, in which the neutralization of the hydrolysate is carried out before or with the pressure release of the corresponding reaction mixture by adding a neutralizer into the outlet end of the horizontal tube digester or into the blow pipe leading to the pressure release chamber.

13. Process according to claim 4, in which the neutralization of the hydrolysate occurs before the first pressure-sealed separation stage by injecting the neutralizer into the outlet end of the horizontal tube digester.

14. Process according to claim 1, in which the reaction mixture, even after the pressure release in the reaction chamber, is kept under certain over pressure, to allow use of the steam released by the pressure release.

15. Process according to any one of claims 1 to 3 in which the chopped biomass is impregnated with acid-containing aqueous dissolution liquid before entry into the filler worm of the first hydrolysis stage.

16. Process according to any one of claims 1 to 3, in which the acid containing aqueous dissolution liquid is injected directly into the pressurized reaction chamber.

17. Process according to any one of the claims 1 to 3, in which the biomass is chopped into grain sizes of about 0.1 to 3 mm, preferably 1 to 2 mm.

18. Process according to any one of claims 1 to 3, in which for further processing of the hydrolysate the neutralized mineral acid is separated from the hydrolysate in the form of a salt of the acid and in which the accumulated remaining biomass consisting mainly of lignin and salt undergo, in the last stage of the process, a two stage combustion in the first stage of which reduction takes place and in the second of which stage, oxidation occurs, in order to recover the mineral acid anhydride and the neutralizer.

19. Apparatus for the continuous hydrolysis of pentosan-containing hemicelluloses, cellulose and corresponding compounds in plant biomass to sugar in which chopped biomass is treated in a first stage in the presence of dilute acid, at temperatures and pressure conditions under which the hemicellulose and, partially, the cellulose are hydrolyzed during a first reaction to pentoses and partially, hexoses, whereupon the reaction mixture pressure is suddenly released and the hydrolysate is separated from the biomass, and in at least a further stage, cellulose in the biomass is hydrolyzed in the presence of dilute mineral acid and under more severe temperature and pressure conditions, to hexoses, whereupon again the reaction mixture pressure is suddenly released and the hydrolysate is separated from the remaining biomass, and in which the neutralized hydrolysate is further processed for the production of sugars, wherein each hydrolysis stage comprises as reaction chamber, a continuously operating horizontal tube digester containing horizontal conveyor devices, the digester being connected on the entrance side with a conical worm filler with a perforated cone casing for the injection of the biomass and the outlet side is fitted with an outlet device which forms a pressure seal for the exit side of the reaction chamber, and which is connected via a blow pipe with a cyclone-shaped blow tank.

20. Apparatus according to claim 19, in which the first separation device for the separation of the hydrolysate in a hydrolysis stage is a worm separator which is directly connected to the outlet end of the tube digester and together with the boiler is under pressure and simultaneously forms the outlet device, and whose perforated cone casing is surrounded by a pressure tight housing.

21. Apparatus according to claim 20, in which after the worm separator, which is under pressure seal, a blow tank is connected and following that further separation devices are connected in the form of worm separators and/or double wire presses.

22. Apparatus, according to claim 21, in which the worm separators are essentially of the same construction as the worm filler.

23. Apparatus according to claim 22, in which in the case of a further separation stage, the worm filler for the following tube boiler may simultaneously serve as a last separation device of the previous stage.

24. Apparatus according to claim 21, in which the further separation devices consist of at least a double wire press which is fitted with two press stretches with separated hydrolysate collection devices for the execution of a two-stage hydrolysate separation.

25. Apparatus according to claim 24, in which a feeder device is provided between the two press to feed fresh water or hydrolysate-containing wash water.

26. Apparatus according to claim 19, in which the plug tube of the worm filler opens directly in the digester tube.

27. Apparatus according to claim 26, in which directly after the exit end of the plug tube in the inner space of the digester, steam injection devices are positioned.

28. Apparatus according to claim 26 or 27, in which the ratio of length to diameter of the plug tube is at least 2:1 and the volume compression ratio of the worm from the worm entry to the plug tube is at least 1:4.

* * * * *